US005178457A

United States Patent [19]

Helmy

[11] Patent Number: 5,178,457

[45] Date of Patent: Jan. 12, 1993

[54] MIXER FIN

[75] Inventor: Nashat N. Helmy, Golden Valley, Minn.

[73] Assignee: Tandem Products, Inc., Minneapolis, Minn.

[21] Appl. No.: 794,448

[22] Filed: Nov. 19, 1991

[51] Int. Cl.[5] ..... B01F 7/08

[52] U.S. Cl. ..... 366/59; 366/227; 366/228; 366/320

[58] Field of Search ..... 69/30; 198/658, 659, 198/676; 416/241 A, 241 R; 366/52, 54, 56, 57, 59, 227, 228, 225, 279, 339, 320

[56] References Cited

U.S. PATENT DOCUMENTS

| | | | |
|---|---|---|---|
| 1,501,566 | 7/1924 | Lundberg | 366/57 |
| 3,173,663 | 3/1965 | Schoonover | 198/676 |
| 3,360,108 | 12/1967 | Voss | 198/659 |
| 3,795,121 | 3/1974 | Cressman | 69/30 |
| 3,967,722 | 7/1976 | Dietert | 198/659 |
| 4,050,676 | 9/1977 | Morishima | 366/339 |
| 4,077,740 | 3/1978 | Sobey | 416/241 A |
| 4,643,647 | 2/1987 | Perry | 416/241 A |
| 4,722,608 | 2/1988 | Salzman | 366/279 |
| 4,810,167 | 3/1989 | Spoltman | 416/241 A |
| 4,842,126 | 6/1989 | McConnell | 198/676 |
| 4,852,219 | 8/1989 | Lapeyre | 198/658 |
| 4,966,527 | 10/1990 | Merz | 416/241 A |
| 4,990,205 | 2/1991 | Barbier | 416/241 A |
| 5,056,924 | 10/1991 | Christenson | 366/59 |

FOREIGN PATENT DOCUMENTS

| | | | |
|---|---|---|---|
| 2724071 | 5/1977 | Fed. Rep. of Germany | 198/659 |

*Primary Examiner*—James E. Bryant, III
*Assistant Examiner*—Terrence R. Till
*Attorney, Agent, or Firm*—Lawrence M. Nawrocki

[57] ABSTRACT

A mixer fin such as those fixedly mounted within rotatable drum mixers. More specifically, a mixer fin comprising of a substantially non-metallic, e.g., polymeric, mixer fin such as those used within rotatable drum mixers, for example to mix concrete. The mixer fin having a non-stretchable cord disposed within the fin so as to minimize fin deformation during the mixing process.

10 Claims, 3 Drawing Sheets

MIXER FIN

TECHNICAL FIELD

This invention relates to improved mixer fins. More specifically, this invention relates to improved mixer fins such as those fixedly mounted within rotatable drum mixers. Yet more specifically, this invention relates to substantially non-metallic, e.g., polymeric, mixer fins such as those used within rotatable drum mixers, for example, to mix concrete.

BACKGROUND OF THE INVENTION

The mixing or agitation of materials, such as concrete, in, for example, a rotary mixer, presents an extremely wearing, abrasive environment. The control and reduction of wear of parts and materials exposed to such environment is of particular interest, for example, the concrete or cement industry. For example, cement trucks having rotary drum mixers, have been a particular focus of attention to the problem of reducing internal wear. One approach to the problem of reducing wear, in a rotary mixer is to line it or coat it with a suitable material. Portable rotary mixers have been lined with, for example, a polyurethane and rubber. Another approach has been to use a polymeric material such as polyurethane, the polymer having dispersed therewithin, a wear-resistant material. Examples of such wear-resistant materials dispersed within a coating would be ceramic tiles or ceramic chips.

One of the problems with utilization of coatings, as described above, is that when the coatings become worn the underlying substrate, which is usually metal, then is exposed to the abrasive, often corrosive material being mixed. Further, once the polymeric coating has been perforated, the ability of the abrasive material to erode the somewhat more abrasion susceptible material thereunder is enhanced. With the coating removed, the underlying metal infrastructure is deferentially worn to the exclusion of the coating.

The problems encountered in employing a coated-interior rotary or rotatable drum mixer is particularly acute for mixing fins deployed within such rotary drums. Mixing fins provide agitation so that material rotating within the mixing drums may be intimately co-mingled. In this manner, the mixing process is enhanced to provide a uniformly, mixed composition, e.g., concrete. Mixing fins are exposed to an even more aggressively eroding and corroding function of the mixer in that the mixing fin is intended to create turbulence and agitation within the materials to be mixed as well as transporting the material e.g., for delivery. As such, mixing fins then require regular replacement in order to maintain their efficacy.

Urethane coated, metal mixing fins have been employed in the prior art. Such fins comprise a substantially metallic upstanding member or backing member, with a urethane coating thereon. Coated metal fins present a particularly difficult problem at time of fin replacement. Coated metallic fins were normally welded to the interior wall rotary mixer. Welding would be accomplished by having the welder physically work within the substantially closed rotary mixer drum. At replacement, the heat of the welding process tends to cause some of the polymeric coating material to vaporize to create an atmosphere which was not particularly healthy for the welder to inhale.

The present invention overcomes the problem of the above prior art and provides an enhanced or improved mixing fin particularly adaptable and useful within large rotary mixers, such as those employed on cement mixer trucks.

BRIEF SUMMARY OF THE INVENTION

Briefly, in one aspect, the present invention is a mixing fin comprising a composite matrix, composite, or matrix material, the fin having within a non-stretchable reinforcing band, cord, or rope means. The composite matrix comprises an elastomeric, flexible, non-metallic polymer. Uniformly dispersed within and throughout the polmer is a non-metallic, particulate material. The non-metallic particulate material must be capable of forming a cohesive interaction or bond with the elastomeric material to provide a cohesive, composite which is abrasion resistant, flexible, and has a low coefficient of friction. Generally speaking, the particulate material will comprise from about ten weight percent to about fifteen weight percent of the composite matrix. In a preferred practice, the particulate material is itself a second polymeric material or elastomer. If necessary, the particulate material optionally may be coated with an adhesive or primer to enhance the interaction between the polymer and the particulate material. A fin of this invention is flexible, abrasion resistant and is substantially non-metallic in its entirety.

As noted above, a fin of the present invention further comprises a woven reinforcing material, or reinforcement means, or cord means such as a non-stretchable cord. A suitable, woven reinforcing material or reinforcement means could be, for example, Kevlar or nylon cord. The reinforcing material or cord is incorporated into or buried within and covered by the fin composite material so as to interact intimately therewith. A cord is positioned within the fin, e.g., parallel to the face of the fin and aligned with its long dimension, so as to reduce fin deformation during the mixing process.

A composite matrix material useable in a fin of this invention has a high flexural modulus, a low coefficient of friction, and a high abrasion resistance so as to withstand the abrasive environment found in, for example, a rotatable drum mixer. A preferred mixer for utilization of the present invention is a rotatable portable mixer normally transported by a cement truck.

The preferred elastomeric or polymeric material of the composite matrix is polyurethane. Other suitable elastomeric materials for use as the primary constituent of the composite include polyesters, polyureas, or rubber.

The term "polymeric material" is used extensively herein. That term is to be broadly construed to include essentially any suitably flexible, low coefficient of friction, abrasion resistant, non-metallic composition having the characteristics described herein.

BRIEF DESCRIPTION OF THE DRAWINGS

A better understanding of the present invention as well as its objects and advantages will become apparent upon consideration of the detailed description below, especially when taken with the accompanying drawings, wherein like numerals designate like parts throughout, and wherein.

DETAILED DESCRIPTION OF THE INVENTION

Figure 1:
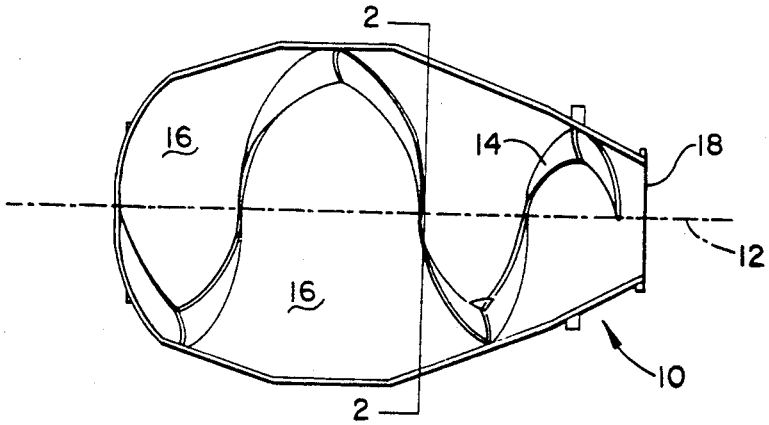
FIG. 1 is a top sectional view of a rotary drum mixer having a mixer fin or flight of the present invention therein.

Thus, there is shown in FIG. 1, a top sectional view of a rotatable drum mixer 10. Mixer 10 would rotate around its axis (line 12) to tumble and therefore intermix materials contained therein. Drum 10 would be, for example, a rotatable drum structure transported by means of a truck, e.g., a cement truck. For purposes of illustration, structure necessary to transport and to rotate drum 10 has been omitted. It is to be understood that essentially any rotatable drum mixer may employ the present invention.

Disposed within drum 10 is mixing or agitating flight or fin 14. Mixing fin 14 is fixedly mounted on the inside wall 16 of drum 10. As shown in this embodiment, fin 14 is a continuous, upstanding structure which is helically disposed within drum 10. Fin 14 is substantially non-metallic Fin 14 is disposed within drum 10 so as to agitate materials contained essentially anywhere therein. Generally, this means fin 14 will be mounted perpendicular to inside wall 16. For purposes of this invention, fin 14 may be continuous (not necessarily smoothly continuous), discrete, or segmented. Substantially any fin construction or configuration may be utilized with this invention. Further, a fin of this invention may be anchored or mounted within drum 10 by any conventional anchoring means. Methods or apparatus for anchoring fin 14 to the inside wall of drum 10 form no part of this invention.

Fin 14 serves two functions. First, and foremost, fin 14 serves to agitate and mix materials contained within drum 10 as it is rotated, e.g., about axis 12. Secondly, fin 14 tends to move material being mixed therein toward the dispenser end or opening 18 of drum 10 where it can be dispensed. In a normal operation, drum 10 would be rotated with materials therein to be mixed. Thus, for example, if drum 10 were the rotatable drum of a cement truck, a mixture of sand, water, aggregate and cement would be mixed therein. While the precise orientation of fin 14 with respect to the inside wall 16 of drum 10 is not critical to this invention, as shown, fin 14 would normally be orthogonal thereto. Fin 14 would be disposed and would be designed to mix and move materials from the left toward the right in FIG. 1.

Figure 2:
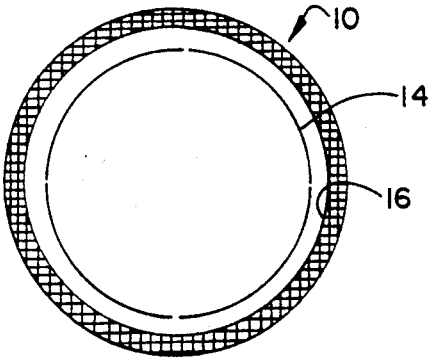
FIG. 2 is a section view of the embodiment of the invention depicted in FIG. 1 taken along line 2—2.

FIG. 2 depicts a sectional view taken along line 2—2 of FIG. 1. FIG. 2 shows drum 10 having fin 14 fixedly mounted on its inside wall 16. From the view point of FIG. 2, fin 14 appears to be substantially circularly disposed within drum 10 even though, as shown in FIG. 1, fin 14 is serpentinely or helically disposed therein.

Figure 3:
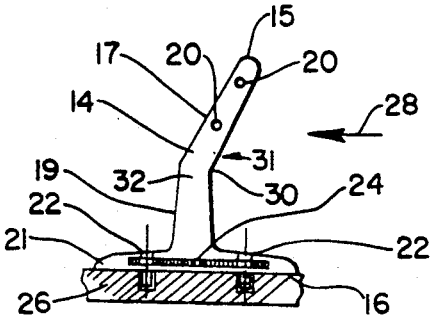
FIG. 3 is a detailed section schematic representation of a fin of the present invention.

FIG. 3 shows a schematic depiction of a mixing fin of the present invention essentially as such a fin would appear in section where line 2—2 of FIG. 1 crosses fin 14. FIG. 3 shows polymeric fin 14 as including non-stretchable, but flexible reinforcing or reinforcement cord means 20 disposed within, generally toward, fin tip 15. Cord means 20 is completely encased within, embedded, or surrounded by fin composite matrix material 32. Cord means 20 is located within fin 14 substantially parallel with its face 31. The reinforcement cord means 20 is preferably non-stretching or non-stretchable flexible cord such as nylon cord or "Kevlar". Cord 20 is disposed within fin 14 so as to restrict or prevent fin 14 from bending during the mixing process, e.g., in response to materials generally coming from the direction of arrow 28. Fin 14 is configured to have a relatively narrow tip or distal section 17 which merges with, a relatively wider fin medial section 19, which itself broadens to a base 21. By means of bolts 22, and an interior metallic base plate 24, fin 14 is affixed to the inside face 16 of drum 10. Other fixation means could be employed. The bulk material 26 of drum 10 into which fin 14 is bolted normally comprises a substantially rigid material such as metal.

The embodiment shown in FIG. 3 includes two cords 20 which provide reinforcement to fin 14 so as to permit it to mix and transport dense, abrasive materials. The precise number of reinforcement cords or reinforcement means used in fin 14 is not critical and may be increased or decreased depending upon user preference. Further, the size or diameter of cord 20 disposed within fin 14 could be adjusted to alter fin rigidity, e.g., in the direction of arrow 28. It is of critical importance that woven reinforcement cord means 20, be substantially non-stretching or non-stretchable. Preferably, cord 20 comprises a non-stretchable, flexible, woven cord or rope.

As illustrated, fin 14 has a bent configuration (at 30). Fin 14 bends at 30 in the direction of arrow 28 so as to provide some additional rigidity to fin 14 to enhance its material mixing and transporting functions. A bent configuration fin or flight is an optional embodiment to the present invention, there being many other fin configurations which would be suggested to one of skill in this art.

Figure 4:
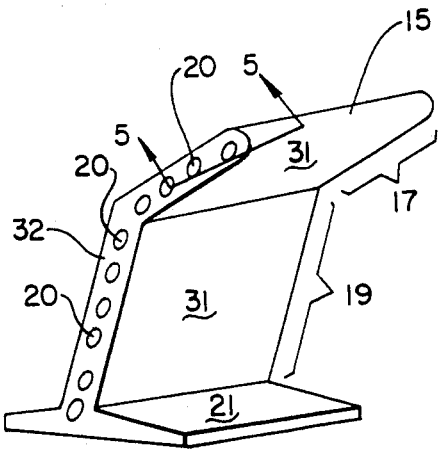
FIG. 4 is a sectional, perspective view of a second embodiment of the present invention.

FIG. 4 is a perspective, partially sectioned view of a further embodiment of a fin of this invention in which a plurality of non-stretching, flexible, woven cords or cord means 20 are utilized in both the top section 17 and the medial section 19 of fin 14. As noted above, the precise number of reinforcement cord means of this invention is not critical. The only limitation is that there be sufficient reinforcement cord means 20 and composite elastomer so that adequate rigidity is imparted to fin 14 to mix and transport materials as the drum is rotated.

Figure 5:
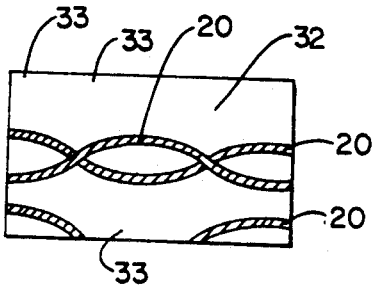
FIG. 5 is a section view of the embodiment to the present invention depicted in FIG. 4 taken along line 5—5.

FIG. 5 shows a sectional, schematic view of a fin of the present invention taken along line 5—5 of FIG. 4. FIG. 5 shows non-stretchable, flexible reinforcing cord means 20 disposed within composite material 32. Composite material 32 comprises a preferred polyurethane elastomer, bulk, primary, or first material and a particulate, non-metallic, secondary or second material 33. As shown, reinforcement means 20 is woven, flexible, and is not substantially stretchable. Composite material 32 has a high abrasion resistance, a high flexural modulus and a low coefficient of friction. Generally speaking, the coefficient of friction of a polymeric material operable in the present invention (i.e., to be the primary constituent of the composite) will be less than that of a steel mixer fin which has been in normal use. A material having such a low coefficient of friction will feel "slippery" to the touch, particularly when coated with water. A fin of the present construction has been found to mix and to transport other materials with reduced effort and less noise.

Polymeric materials of the present invention also have a high abrasion resistance. For example, polymeric material generally suitable for mixing and transporting a highly abrasive material such as concrete will have an abrasion resistance in the range of Shore "A"-90 to Shore "D"-70. Materials having such an indicated abrasion resistance will provide an especially long-lived fin. Essentially any polymeric material having the above characteristics will be operable in the present invention.

As noted above, polyurethane is a particularly preferred polymeric material for use as the primary constituent of the fin composite. As is well known, polyurethane is the reaction product of isocyanate, and a polyol. One specific polyurethane is a material generated by reacting methylene diphenyldiisocyanate with, on an equivalence basis, polytetramethylene glycol polyol. Polytetramethylene glycol is generically an example of a polyol used to react with an isocyanate to create polyurethane.

A particularly preferred composite material for utilization in the present invention is the above-described polyurethane which includes an additive amount of a particulate, non-metallic, e.g., plastic material. Polymeric materials constitute a preferred class of particulate species useable to produce the fin composite. The particulate component of the composite can be, for example, high density polyethylene, Nylon-6 or ultra-high molecular weight (UHMW) polyethylene. Modified UHMW polyethylene particulate material added to the polyurethane precursors before reaction in the ten to fifteen weight percent range noted above provides a surprising and unexpected increase in composite fin stiffness without lowering its coefficient of friction. Further, the additive amount of UHMW polyethylene particulate does not reduce abrasion resistance of the elastomer bulk material and thereby provides a particularly preferred composite for use in the present fin.

In a preferred practice, it may be necessary to coat the particulate with an adhesive or a primer in order to obtain suitable interaction between, e.g., a polyurethane polymeric material, and the particulate. The particulate material should not be present in any amount, e.g., by volume percent of the composite, so as to reduce fin performance characteristics.

A fin of this invention is surprisingly long lasting and efficient at mixing and delivering materials. In some instances, the fin may out-last the drum to which it is attached. A dramatic reduction in concrete buildup also has been found in testing fins of this invention. Moreover, concrete delivery times have been reduced by as much as one-half. The fin simply out-performs and out-lasts similarly configured fins of other materials.

Figure 6:
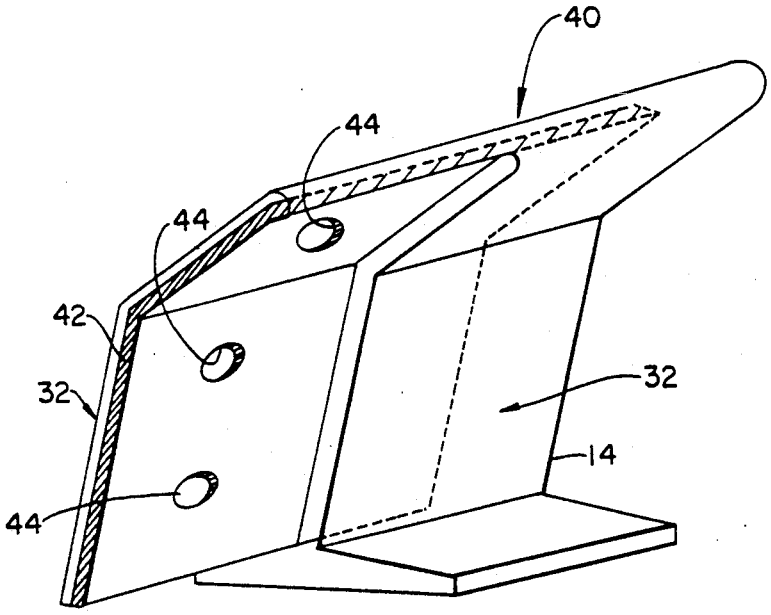
FIG. 6 is a fin segment illustrating a preferred fin connector section.

FIG. 6 shows a partially sectioned, perspective view of a preferred composite fin connector section 40. Embedded within, e.g., a urethane composite fin 14, is a fiberglass sheet insert 42. Insert 42 is of the same cross-sectional configuration as fin 14. Holes 44 have been drilled through fin composite 32 and insert 42. Adjacent segments of composite fin 14 would be coupled or connected by passing bolts (not shown) through holes 44. Obviously, in such a connector section, it may be necessary to omit cord means 20 for a short portion of the section.

Numerous characteristics and advantages of the invention covered by this document have been set forth in the foregoing description. It will be understood, however, that this disclosure is, in many respects, only illustrative. Changes may be made in details, particularly in matters of shape, size, and arrangement of parts without exceeding the scope of the invention. The invention's scope is, of course, defined in the language in which the appended claims are expressed.

What is claimed is as follows:

1. A mixing fin adapted to mix materials contained within a rotatable drum mixer, the fin upstanding from the interior of the mixer, and comprising a composite of:

polymeric material having a high abrasion resistance, a high flexural modulus, and a low coefficient of friction, the polymeric material having uniformly dispersed therethrough, particular, plastic non-metallic material of forming a cohesive interaction with the polymeric material, the fin further comprising:

means disposed within said fin so as to minimize fin deformation during mixing, said means comprising a non-stretchable cord.

2. A fin according to claim 1 wherein the particulate material is polymeric.

3. A fin according to claim 1 wherein the polymeric material is polyurethane.

4. A fin according to claim 1 wherein the polymeric material is polyurethane and the particulate is ultra-high molecular weight polyethylene.

5. A fin according to claim 1 wherein the polymeric material has an abrasion resistance in the range of about Shore "A"-90 to Shore "D"-70 and a low coefficient of friction.

6. A fin according to claim 1 wherein the fin comprises polymeric material substantially in its entirety.

7. A mixing fin adapted to mix materials contained within a rotatable drum of a cement truck, the fin upstanding from the interior of the drum and comprising substantially in its entirety composite structure, the composite structure comprising abrasion resistant, high flexural strength, low coefficient of friction, polymeric elastomeric matrix material, the elastomeric material having dispersed therethrough particulate, non-metallic plastic material, forming a cohesive interaction with the polymeric elastomeric matrix material, the fin further including therewithin:

means disposed within the body of the fin so as to minimize fin deformation during mixing, said means comprising a flexible, non-stretchable, woven cord.

8. A fin according to claim 7 wherein the particulate is a polymer and comprises about ten weight percent to fifteen weight percent of the composite.

9. A mixing fin according to claim 7 wherein the matrix material is polyurethane, the particulate is UHMW polyethylene, and the cord is nylon cord.

10. A fin according to claim 7 wherein the matrix material has an abrasion resistance in the range of Shore "A"-90 to Shore "D"-70.

* * * * *